US009297182B2

(12) United States Patent
Moody et al.

(10) Patent No.: US 9,297,182 B2
(45) Date of Patent: Mar. 29, 2016

(54) HANDLE MOUNTING INSERT

(71) Applicant: Electrolux Home Products, Inc., Charlotte, NC (US)

(72) Inventors: William Lee Moody, Anderson, SC (US); Nilton Carlos Bertolini, Chonburi (TH)

(73) Assignee: ELECTROLUX HOME PRODUCTS, INC., Charlotte, NC (US)

( * ) Notice: Subject to any disclaimer, the term of this patent is extended or adjusted under 35 U.S.C. 154(b) by 179 days.

(21) Appl. No.: 13/897,624

(22) Filed: May 20, 2013

(65) Prior Publication Data

US 2014/0338152 A1 Nov. 20, 2014

(51) Int. Cl.

| | |
|---|---|
| ***A45C 3/00*** | (2006.01) |
| ***E05B 1/00*** | (2006.01) |
| *F25D 23/02* | (2006.01) |

(52) U.S. Cl.

CPC ..... *E05B 1/0015* (2013.01); *F25D 23/028* (2013.01); *Y10T 16/458* (2015.01)

(58) Field of Classification Search

CPC ..... F25D 23/02; F25D 23/028; E05B 1/0015; A47B 95/02; Y10T 16/458; Y10T 16/498

USPC ..... 16/412

See application file for complete search history.

(56) References Cited

U.S. PATENT DOCUMENTS

| | | | | |
|---|---|---|---|---|
| 3,017,657 | A * | 1/1962 | Mills | 16/413 |
| 7,793,388 | B2 | 9/2010 | Wing | |
| 7,849,563 | B2 | 12/2010 | Wing | |
| 7,870,647 | B2 | 1/2011 | Steurer | |
| 8,732,910 | B1 * | 5/2014 | Paul et al. | 16/413 |
| 2006/0200948 | A1 | 9/2006 | Steurer | |
| 2008/0034553 | A1 * | 2/2008 | Wing | 16/412 |
| 2008/0180011 | A1 * | 7/2008 | Leimkuehler et al. | 312/405 |
| 2008/0313853 | A1 | 12/2008 | Hale | |
| 2009/0007385 | A1 * | 1/2009 | Kim | 16/412 |
| 2010/0005631 | A1 * | 1/2010 | Drach et al. | 16/436 |
| 2011/0050068 | A1 | 3/2011 | Wing | |

(Continued)

FOREIGN PATENT DOCUMENTS

| | | |
|---|---|---|
| EP | 1656868 A2 | 5/2006 |
| EP | 1695647 A2 | 8/2006 |

OTHER PUBLICATIONS

International Search Report and Written Opinion issued in Application No. PCT/US2014/037311 dated Sep. 15, 2014.

*Primary Examiner* — Victor Batson
*Assistant Examiner* — Matthew Sullivan
(74) *Attorney, Agent, or Firm* — Pearne & Gordon LLP

(57) ABSTRACT

A handle assembly for a door includes at least a support member, an elongate handle body, an insert and a fastener. The elongate handle body includes an opening at a handle end. An outer hole is formed on a shell of the handle body near the handle end so as to be in communication with the opening. The insert is configured to be inserted into the opening. The insert includes an aperture and an inner hole. The aperture is configured to accommodate the support member mounted on a door. The inner hole is configured to be aligned with the outer hole and be in communication with the aperture. The insert includes a protrusion that protrudes into the aperture. The fastener is configured to be inserted through the outer hole and the inner hole and press the support member against the protrusion such that the protrusion extends into a neck portion of the support member.

14 Claims, 4 Drawing Sheets

(56) References Cited

U.S. PATENT DOCUMENTS

2012/0074826 A1* 3/2012 Klaus et al. ..... 312/405
2012/0234993 A1* 9/2012 Byrne et al. ..... 248/201
2013/0285527 A1* 10/2013 Choi et al. ..... 312/404
2014/0338152 A1* 11/2014 Moody et al. ..... 16/412

* cited by examiner

HANDLE MOUNTING INSERT

TECHNICAL FIELD

The present disclosure relates to a door handle and, more particularly, to apparatuses and methods for mounting a handle on a door.

BACKGROUND

A cabinet structure often includes various enclosed spaces that are accessible through a door. The door is generally equipped with a handle by way of which the door can be manipulated for opening and closing. There are a variety of ways in which the handle can be mounted to an outer surface of the door. However, the manner in which the handle is mounted to the door may not be sufficiently sturdy and the handle may be susceptible to being pulled out of the door.

Therefore, there is a need for apparatuses and methods that keep the handle fastened to the door in a sturdy fashion.

SUMMARY

In one example aspect, a handle assembly for a door is provided and includes a first support member, a second support member, an elongate handle body, a first insert, a second insert, a first fastener and a second fastener. The first support member is configured to be mounted on a door and includes a first neck portion. The second support member is configured to be mounted on a door and includes a second neck portion. The elongate handle body includes a first opening at a first handle end and a second opening at a second handle end. The handle body is substantially defined by a shell. A first outer hole is formed on the shell near the first handle end so as to be in communication with the first opening. A second outer hole is formed on the shell near the second end so as to be in communication with the second opening. A first insert is configured to be inserted into the first opening and includes a first aperture and a first inner hole. The first aperture is configured to accommodate the first support member. The first inner hole is configured to be aligned with the first outer hole and be in communication with the first aperture. The first insert includes a first protrusion that protrudes into the first aperture. A second insert is configured to be inserted into the second opening and includes a second aperture and a second inner hole. The second aperture is configured to accommodate the second support member. The second inner hole is configured to be aligned with the second outer hole and be in communication with the second aperture. The first insert includes a second protrusion that protrudes into the second aperture. A first fastener is configured to be inserted through the first outer hole and the first inner hole and press the first support member against the first protrusion such that the first protrusion extends into the first neck portion. A second fastener is configured to be inserted through the second outer hole and the second inner hole and press the second support member against the second protrusion such that the second protrusion extends into the second neck portion.

In one example of the example aspect, the first aperture includes a first interior perimeter. The first inner hole is located across the first protrusion along the first interior perimeter. The second aperture includes a second interior perimeter. The second inner hole is located across the second protrusion along the second interior perimeter.

In another example of the example aspect, the first protrusion is shaped as a first bank extending along the first interior perimeter and the second protrusion is shaped as a second bank extending along the second interior perimeter.

In yet another example of the example aspect, the first bank extends along substantially half of the first interior perimeter, and the second bank extends along substantially half of the second interior perimeter.

In yet another example of the example aspect, the first protrusion is tapered toward a center of the first aperture, and the second protrusion is tapered toward a center of the second aperture.

In yet another example of the example aspect, the first bank includes ends that are chamfered, and the second bank includes ends that are chamfered.

In yet another example of the example aspect, each of the first and second support members includes an outer portion having an hourglass configuration. The first protrusion has a triangular cross-section shaped to mate with the first neck portion. The second protrusion has a triangular cross-section shaped to mate with the second neck portion.

In yet another example of the example aspect, each of the first and second fasteners includes a tip configured to engage the first support member and the second support member. The tip has a conical configuration shaped to fit with the first neck portion and the second neck portion.

In yet another example of the example aspect, each of the first interior perimeter and the second interior perimeter is configured as an oval with a first side at which the first protrusion and the second protrusion are formed and a second side at which the first inner hole and the second inner hole are formed. The first support member and the second support member are movable within the oval.

In yet another example of the example aspect, the location of the first support member within the first aperture is configured to shift from the second side to the first side as the first fastener is inserted. The location of the second support member within the second aperture is configured to shift from the second side to the first side as the second fastener is inserted.

In yet another example of the example aspect, the handle body includes a longitudinal axis. The first outer hole and the second outer hole extends transversely about the longitudinal axis.

In another example aspect, a handle assembly for a door is provided and including a first support member, a second support member, an elongate handle body, a first insert, a second insert, a first fastener and a second fastener. The first support member is configured to be mounted on a door and includes a first neck portion. The second support member is configured to be mounted on a door and includes a second neck portion. The elongate handle body includes a first opening at a first handle end and a second opening at a second handle end. The handle body is substantially defined by a shell. A first outer hole is formed on the shell near the first handle end so as to be in communication with the first opening. A second outer hole is formed on the shell near the second end so as to be in communication with the second opening. The first insert is configured to be inserted into the first opening and includes a first aperture and a first inner hole. The first aperture is configured to accommodate the first support member. The first inner hole is configured to be aligned with the first outer hole and be in communication with the first aperture. The first insert includes a first protrusion that protrudes into the first aperture. The first aperture includes a first interior perimeter. The first inner hole is located across the first protrusion along the first interior perimeter. The first protrusion is shaped as a first bank extending along the first interior perimeter. The second insert is configured to be inserted into the second opening and includes a second aperture and a second inner hole. The second aperture is configured to accommodate the second support member. The second inner hole is configured to be aligned with the second outer hole and be in communication with the second aperture. The first insert includes a second protrusion that protrudes into the second aperture. The second aperture includes a second interior perimeter. The second inner hole is located across the second protrusion along the second interior perimeter. The second protrusion is shaped as a second bank extending along the second interior perimeter. The first fastener is configured to be inserted through the first outer hole and the first inner hole and press the first support member against the first protrusion such that the first protrusion extends into the first neck portion. The second fastener is configured to be inserted through the second outer hole and the second inner hole and press the second support member against the second protrusion such that the second protrusion extends into the second neck portion. Each of the first and second support members includes an outer portion having an hourglass configuration. The first protrusion has a triangular cross-section shaped to mate with the first neck portion. The second protrusion has a triangular cross-section shaped to mate with the second neck portion. Each of the first and second fasteners includes a tip configured to engage the first support member and the second support member. The tip has a conical configuration shaped to fit with the first neck portion and the second neck portion.

In yet another example aspect, a handle assembly for a door is provided and including a first support member, a second support member, an elongate handle body, a first insert, a second insert, a first fastener and a second fastener. The first support member is configured to be mounted on a door and includes a first neck portion. The second support member is configured to be mounted on a door and includes a second neck portion. The elongate handle body includes a first opening at a first handle end and a second opening at a second handle end. The handle body is substantially defined by a shell. A first outer hole is formed on the shell near the first handle end so as to be in communication with the first opening. A second outer hole is formed on the shell near the second end so as to be in communication with the second opening. The first insert is configured to be inserted into the first opening and includes a first aperture and a first inner hole. The first aperture is configured to accommodate the first support member. The first inner hole is configured to be aligned with the first outer hole and be in communication with the first aperture. The first insert includes a first protrusion that protrudes into the first aperture. The first aperture includes a first interior perimeter. The first inner hole is located across the first protrusion along the first interior perimeter. The first protrusion is shaped as a first bank extending along the first interior perimeter. The second insert is configured to be inserted into the second opening and includes a second aperture and a second inner hole. The second aperture is configured to accommodate the second support member. The second inner hole is configured to be aligned with the second outer hole and be in communication with the second aperture. The first insert includes a second protrusion that protrudes into the second aperture. The second aperture includes a second interior perimeter. The second inner hole is located across the second protrusion along the second interior perimeter. The second protrusion is shaped as a second bank extending along the second interior perimeter. The first fastener is configured to be inserted through the first outer hole and the first inner hole and press the first support member against the first protrusion such that the first protrusion extends into the first neck portion. The second fastener is configured to be inserted through the second outer hole and the second inner hole and press the second support member against the second protrusion such that the second protrusion extends into the second neck portion. Each of the first interior perimeter and the second interior perimeter is configured as an oval with a first side at which the first protrusion and the second protrusion are formed and a second side at which the first inner hole and the second inner hole are formed. The first support member and the second support member are movable within the oval. The location of the first support member within the first aperture is configured to shift from the second side to the first side as the first fastener is inserted. The location of the second support member within the second aperture is configured to shift from the second side to the first side as the second fastener is inserted.

BRIEF DESCRIPTION OF THE DRAWINGS

These and other aspects are better understood when the following detailed description is read with reference to the accompanying drawings, in which.

DETAILED DESCRIPTION

Figure 1:
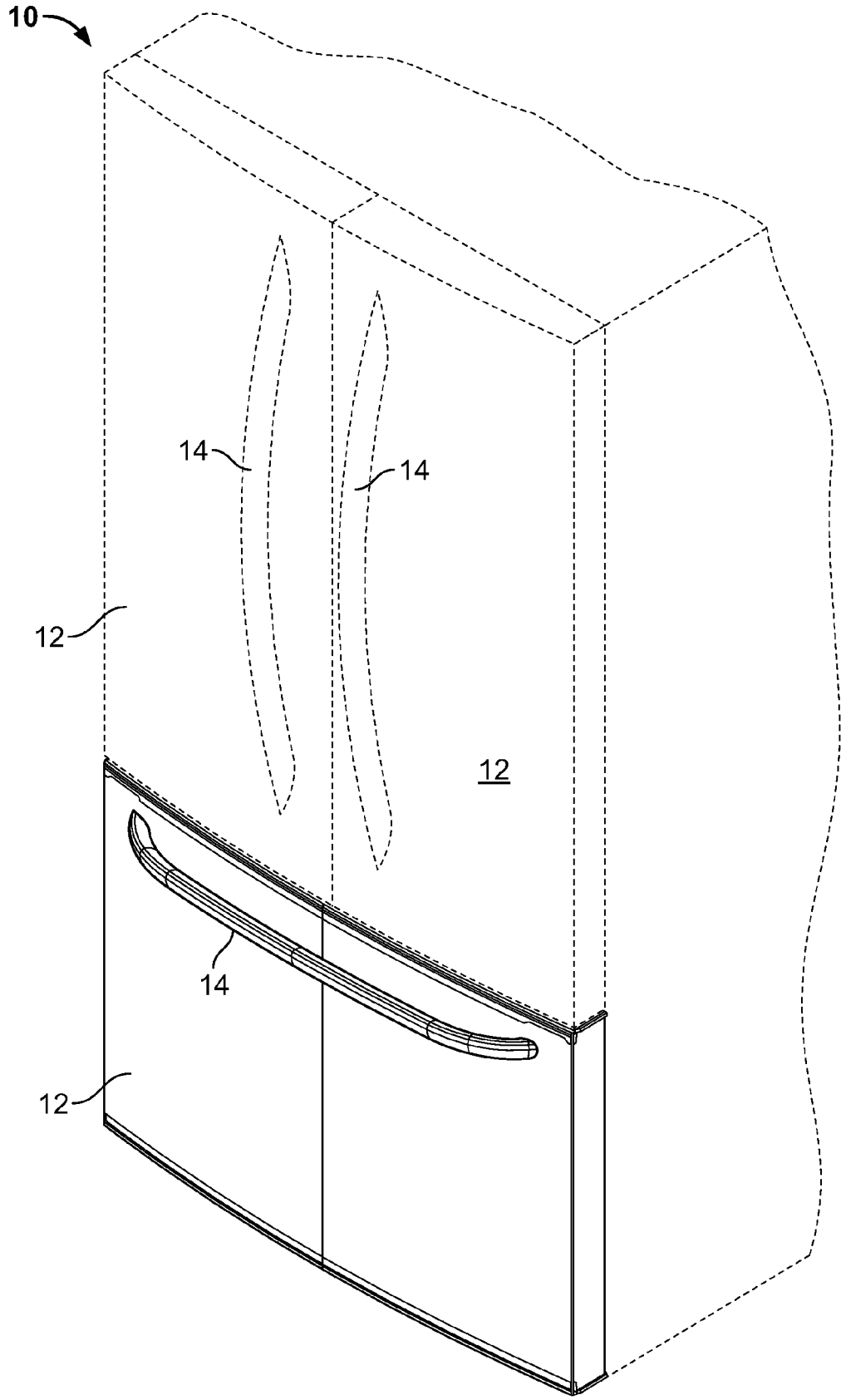
FIG. 1 is a view of an example embodiment of a cabinet structure including a plurality of compartments accessible through a door where a handle assembly is used to mount a handle on the door.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring now to FIG. 1, an example embodiment of a cabinet structure 10 including one or more doors 12 is shown. The example cabinet structure 10 may provide a number of compartments with enclosed environments in order to store items for the purpose of refrigeration, heating, sterilization or the like. These compartments may be accessed by way of a door 12 that may be provided with a handle 14 as shown in FIG. 1. Although the example handle 14 in FIG. 1 is shown to be mounted horizontally, the handle 14 may be mounted in a different orientation (e.g., vertically). Moreover, while the door 12 is part of a slidable drawer, the handle 14 may be mounted on a door 12 that operates in a different manner. For example, the handle 14 may be mounted on a door 12 that pivots around a vertical or horizontal axis.

A handle assembly is provided to allow the handle 14 to be secured to the door 12. The handle assembly may include a handle body 16, a pair of support members 18, a pair of inserts 20 and a pair of fasteners 22.

Figure 2:
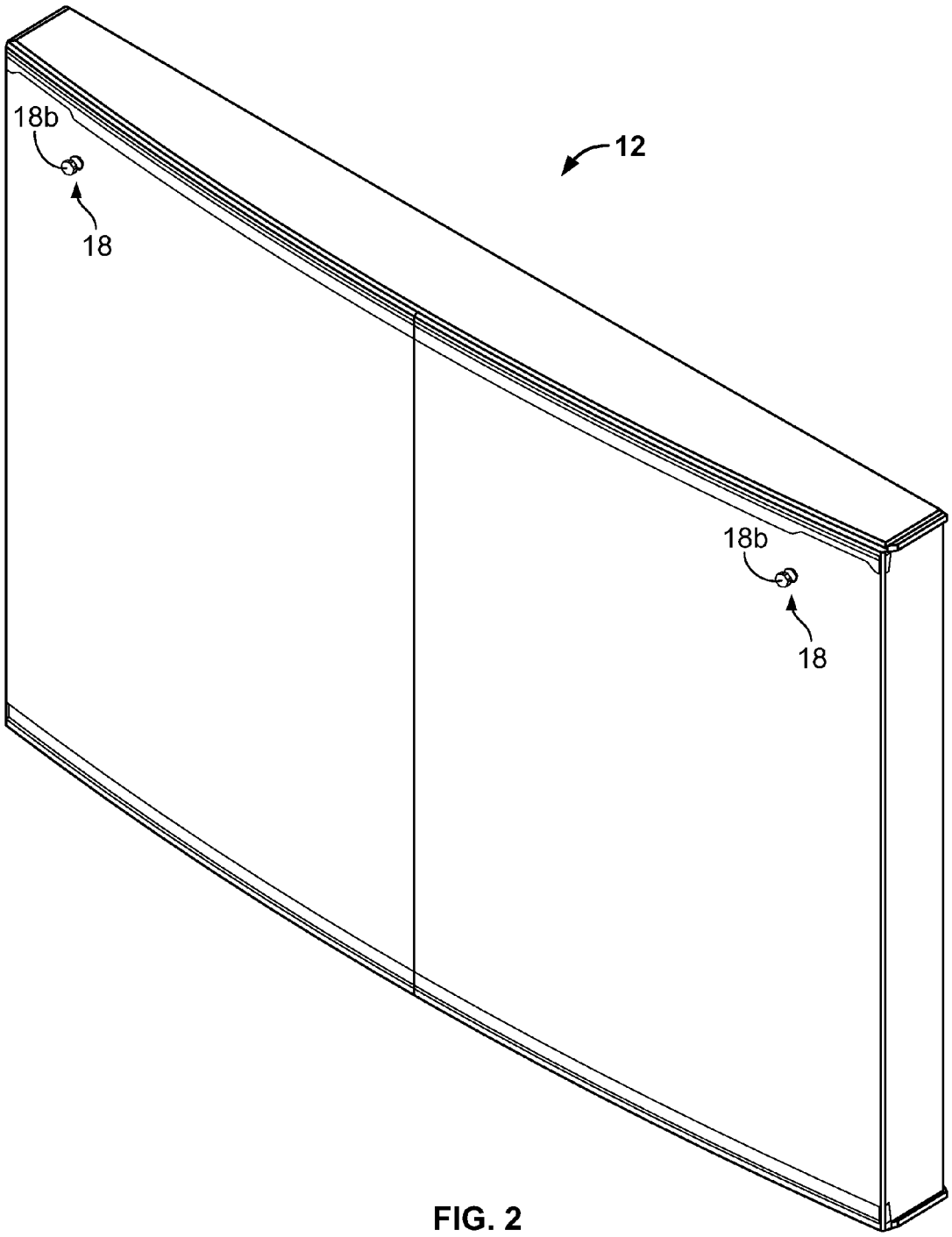
FIG. 2 is a perspective view of a door detached from the cabinet structure showing support members of the handle assembly mounted on the door.
Figure 5:
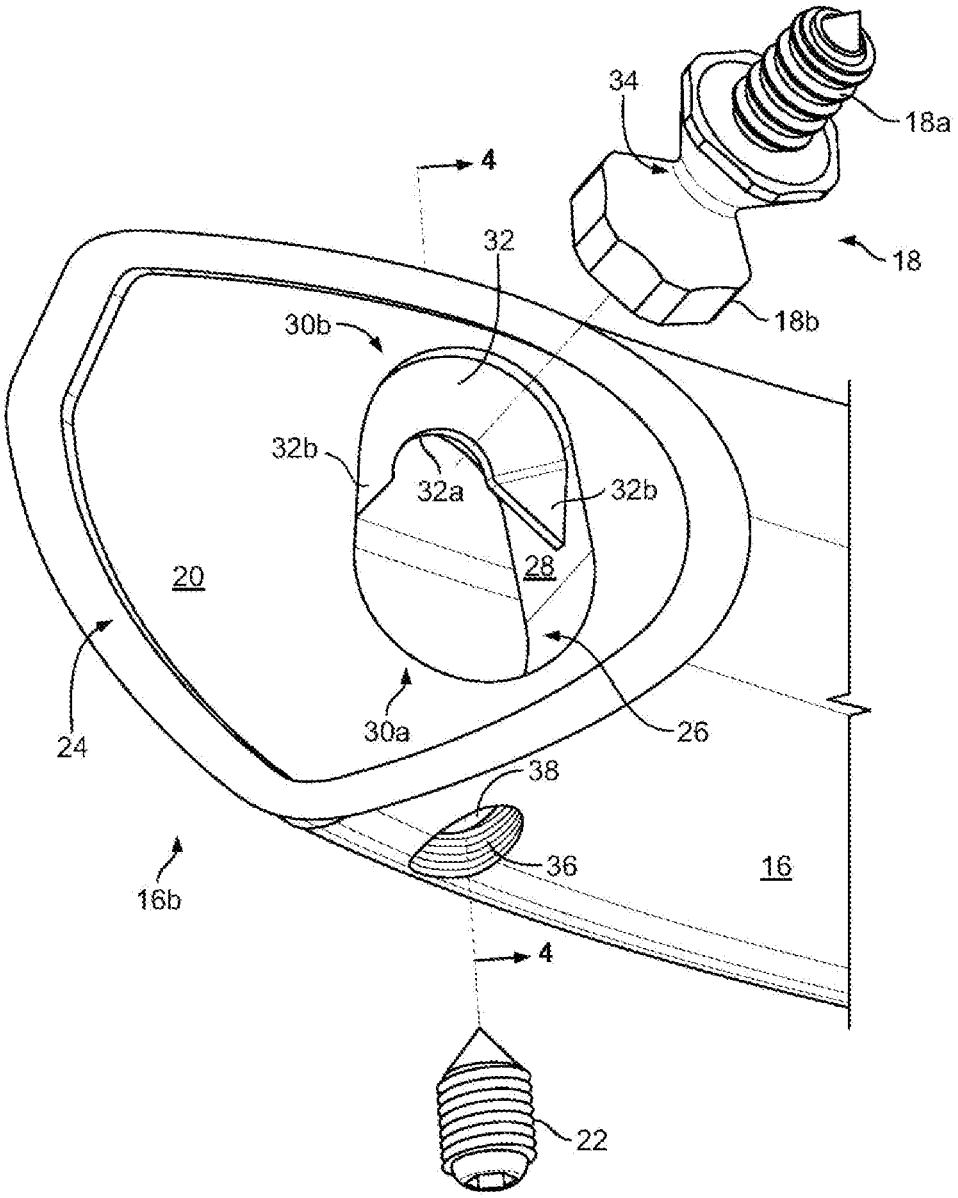
FIG. 5 is an exploded perspective view of the handle end of the handle body showing the support member, an insert and a fastener.

As shown in FIG. 2, the support members 18 are configured to be mounted on the door 12 and link the other components of the handle assembly to the door 12. The support members 18 may include an inner portion 18*a* and an outer portion 18*b* as shown in FIG. 5. As shown in FIG. 2, the inner portion 18*a* may be threaded to allow the support members 18 to be fastened to the door 12 by screwing the inner portion into the door 12. The outer portion 18*b* projects from a surface of the door 12 and allows the other components of handle body 16 to be suspended to the door 12 as described below.

Figure 3:
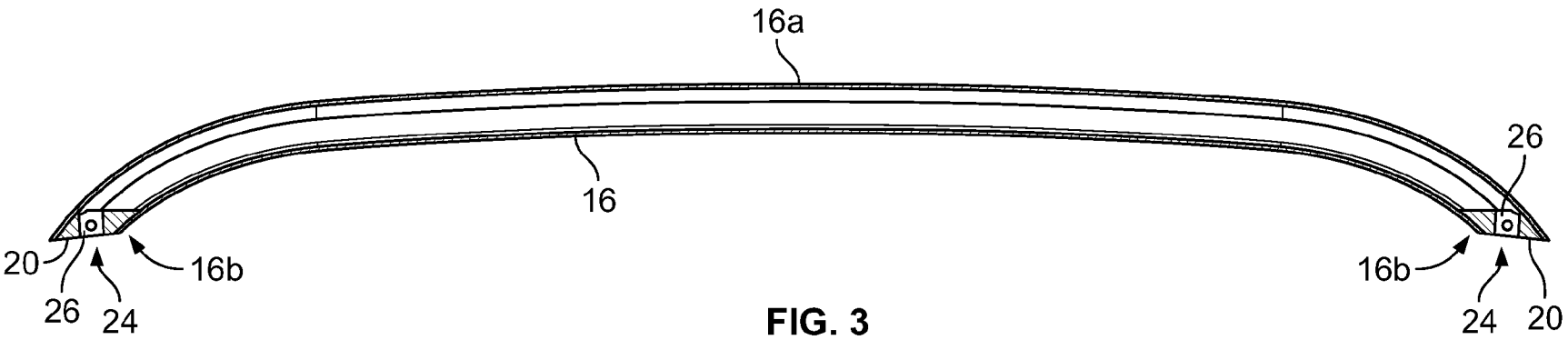
FIG. 3 is a cross-sectional view of a handle body of the handle assembly along the longitudinal axis of the handle body.

The handle body 16 may be substantially curved, straight or a combination of curved or straight sections and may be sufficiently elongate so as to extend from one support member 18 to another support member 18. In the present embodiment, the handle body 16 is U-shaped with a substantially straight intermediate section 16*a* and curved handle ends 16*b* as shown in FIG. 3. The handle assembly may be symmetrical about the center of the handle body 16. Each handle end 16*b* of the handle body 16 may provide a surface that is configured to contact the door 12. The surface may include an opening 24 that extends throughout the entire handle body 16 such that the handle body 16 is defined by a hollow, tubular shell. Alternatively, the opening 24 may extend partly into the handle body 16 such that an opening 24 is present at each handle end 16*b* and the handle body 16 may have a tubular section at each handle end 16*b* and an intermediate section with a filled interior between the tubular sections. Even though the handle body 16 is hollow such that the opening 24 extends from one handle end 16*b* to another handle end 16*b* as shown in FIG. 3, each end of the handle body 16 may be described as including an opening 24.

Figure 4:
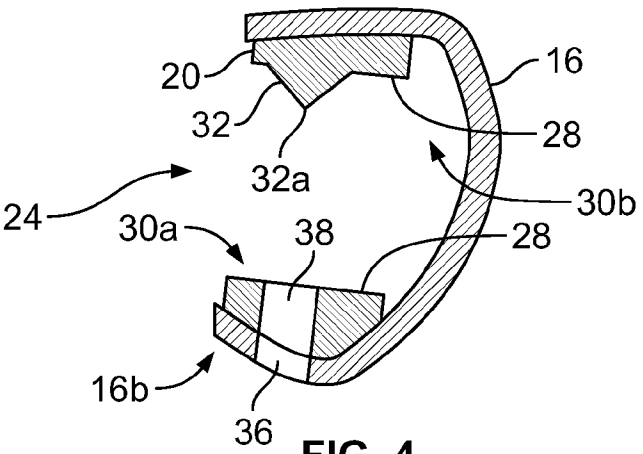
FIG. 4 is a cross-sectional view of the handle body along a plane transverse to the longitudinal axis near a handle end.

The inserts 20 for the handle assembly may be configured to be inserted in the opening 24 at each handle end 16*b* and may provide features through which the handle 14 may be mounted to the door 12. The support members 18 are mounted on the door 12 spaced apart such that each handle end 16*b* can engage a support member 18. The shape of the insert 20 is such that the insert 20 can substantially fit within the opening 24 at the handle end 16*b*. For example, the insert 20 may be dimensioned so as to cause a friction fit between the insert 20 and the opening 24 or the insert 20 may be secured in the opening 24 through other means known in the art (e.g., glue). The insert 20 may include an aperture 26 configured to accommodate a support member 18. The aperture 26 may extend through the insert 20 as shown in FIGS. 3-4 and the support member 18 may emerge on the other side of the insert 20. Alternatively, the aperture 26 may be a blind hole formed on the insert 20. Laterally of the direction in which the support member 18 is inserted into the aperture 26, the aperture 26 is surrounded and defined by an inner wall 28. The interior perimeter of the inner wall 28 may be configured in an oval shape as shown in FIG. 5, a circular shape, etc. and may be dimensioned to allow for some play between the support member 18 and the interior perimeter of the inner wall 28. Thus, the handle end 16*b* is movable such that the location of the support member 18 within the aperture 26 shifts from one side to the other side. In the present embodiment, the oval tapers from one side (i.e., a wide side 30*a*) to the other (i.e., a narrow side 30*b*) and a protrusion 32 may be formed to extend along the interior perimeter of the narrow side 30*b* in a semi-annular fashion as shown in FIG. 5. The protrusion 32 may be shaped like a bank which may extend along substantially half of the entire interior perimeter or along the narrow side 30*b* of the interior perimeter as shown in FIG. 5. The cross-section of the protrusion 32 may be tapered toward the center of the aperture 26. For example, the protrusion 32 may be ridge-like and the part of the protrusion 32 that extends toward the center of the aperture 26 may have a triangular cross-section as shown in FIG. 4. Moreover, the protrusion 32 may include ends 32*b* that function as a ramp between the interior perimeter of the wide side 30*a* and an apex 32*a* of the protrusion 32 as shown in FIG. 5. The ends 32*b* of the protrusion 32 may be chamfered, beveled, curved or the like in order to shape the ends 32*b* into a ramped feature.

The outer portion 18*b* of the support member 18 is configured to be inserted into the aperture 26 of the insert 20 and may be shaped and dimensioned to substantially fit within the narrow side 30*b*. Specifically, the outer portion 18*b* of the support member 18 may include a neck portion 34 with an hourglass configuration such that the protrusion 32 with the triangular cross-section can mate with the neck portion 34 of the outer portion 18*b*. The dimensions of the narrow side 30*b* of the aperture 26 may be such that the outer portion 18*b* of the support member 18 substantially fits therein while the dimensions of the wide side 30*a* of the aperture 26 may allow the outer portion 18*b* to be inserted freely without significant interference. Moreover, the ramped ends 32*b* of the protrusion 32 are provided to fix misalignment of the neck portion 34 about the aperture 26 and help center the protrusion 32 with respect to the neck portion 34 of the support member 18. Furthermore, the triangular cross-section of the protrusion 32 and the hourglass configuration of the neck portion 34 may also bring the support member 18 to a predetermined level relative to the aperture 26 of the insert 20.

The shell around the opening 24 of the handle body 16 may include an outer hole 36 that is in communication with the opening 24. The insert 20 may also include an inner hole 38 that is in communication with the aperture 26 near the interior perimeter. The insert 20 is mounted within the opening 24 such that the outer hole 36 is aligned with the inner hole 38 and such that the fastener 22 can be inserted through both the outer hole 36 and the inner hole 38 to engage the neck portion 34 of the support member 18. As shown in FIG. 5, the protrusion 32 and the holes 36, 38 may be located transversely about the longitudinal axis of the handle body 16. Once inserted, the fastener 22 is configured to secure the support member 18 within the aperture 26 and thus secure the handle end 16*b* to the door 12. The fastener 22 may have a threaded exterior as shown in FIG. 5 and the outer hole 36 and the inner hole 38 may also be threaded to be engaged by the fastener 22. Moreover, the fastener 22 may have a tip that has a conical configuration and may be shaped to fit with the neck portion 34 of the support member 18. Furthermore, the inner hole 38 and outer hole 36 may be located across or directly opposite the center of the protrusion 32 along the interior perimeter and may be positioned to direct the fastener 22 toward the center of the protrusion 32. However, it may also be possible to insert the fastener 22 from a different direction and/or position and still adjust the position of the insert 20 such that the neck portion 34 presses against the protrusion 32. Under the present configuration, the fastener 22 is configured to contact the center of the neck portion 34 and bring the protrusion 32 toward the support member 18 by inserting the fastener 22 into the outer hole 36 and inner hole 38 such that the protrusion 32 extends into the neck portion 34.

In one manner of assembling the aforementioned handle assembly, the support members 18 are mounted on the door 12 by screwing the threaded inner portion 18*a* into the surface of the door 12. The support members 18 are mounted a predetermined distance apart on the surface of the door 12 which corresponds to the distance between the apertures 26 of the handle ends 16*b*. An insert 20 is inserted into the opening 24 at each handle end 16*b* of the handle body such that the outer hole 36 on the shell is aligned with the inner hole 38 of the insert 20. The handle 14 is placed on the door 12 such that the outer portion 18*b* of the support member 18 is inserted into the wide side 30*a* of the aperture 26 of the respective insert 20. Thereafter, the fastener 22 is inserted into the outer hole 36 and inner hole 38, for example. Once the fastener 22 is sufficiently inserted to engage the neck portion 34, additional screwing of the fastener 22 moves the handle end 16*b* such that the narrow side 30*b* of the aperture 26 is brought toward the neck portion 34 and the protrusion 32 is centered around the neck portion 34. Although the support members 18 cannot actually move once mounted on the door 12, the handle ends 16*b* can be moved with respect to the support member 18 and the support members 18 can thus move relative to the aperture 26. Moreover, the triangular cross-section of the protrusion 32 is configured to mate with the hourglass configuration of the neck portion 34 and also helps bring the handle end 16*b* to a predetermined level about the support member 18 since the apex of the protrusion 32 is directed toward the narrowest part of the neck portion 34. The neck portion 34 becomes centered about the protrusion 32 by the insertion of the fastener 22 and the handle ends 16*b* can be positioned at the desired locations on the door 12 in a simple manner. Furthermore, the engagement of the neck portion 34 by the protrusion 32 mounts the handle end 16*b* in a sturdy fashion to the door 12 and makes it difficult for the handle end 16*b* to come off from the door 12 by suddenly pulling the handle 14.

It will be apparent to those skilled in the art that various modifications and variations can be made without departing from the spirit and scope of the claimed invention.

What is claimed is:

1. A handle assembly for a door, the handle assembly including:

a first support member mountable to a door, the first support member having an hourglass configuration including a first neck portion;

a second support member mountable to the door, the second support member having an hourglass configuration including a second neck portion;

an elongate handle body extending along a longitudinal axis, including a first opening at a first handle end and a second opening at a second handle end, the handle body substantially defined by a shell, a first outer hole formed on the shell near the first handle end so as to be in communication with the first opening, a second outer hole formed on the shell near the second end so as to be in communication with the second opening;

a first insert removably inserted into the first opening, the first insert including a first aperture, a first inner hole, and a first protrusion, wherein the first aperture accommodates the first support member, and wherein the first inner hole is aligned with the first outer hole and is in communication with the first aperture, and wherein the first protrusion protrudes into the first aperture and has a triangular cross-section on a first plane transverse to the longitudinal axis, and the first protrusion is shaped to mate with the first neck portion;

a second insert removably inserted into the second opening, the second insert including a second aperture, a second inner hole, and a second protrusion, wherein the second aperture accommodates the second support member, and wherein the second inner hole is aligned with the second outer hole and is in communication with the second aperture, the second protrusion protrudes into the second aperture and has a triangular cross-section on a second plane transverse to the longitudinal axis, and the second protrusion is shaped to mate with the second neck portion;

a first fastener inserted through the first outer hole and the first inner hole and pressing the first support member against the first protrusion such that the first protrusion extends into the first neck portion; and a second fastener inserted through the second outer hole and the second inner hole and pressing the second support member against the second protrusion such that the second protrusion extends into the second neck portion.

2. The handle assembly of claim 1, the first aperture including a first interior perimeter, the second aperture including a second interior perimeter.

3. The handle assembly of claim 2, the first protrusion shaped as a first bank extending from a portion of the first interior perimeter, the second protrusion shaped as a second bank extending from a portion of the second interior perimeter.

4. The handle assembly of claim 3, the first bank extending along substantially half of the first interior perimeter, the second bank extending along substantially half of the second interior perimeter.

5. The handle assembly of claim 3, the first protrusion tapered toward a center of the first aperture, the second protrusion tapered toward a center of the second aperture.

6. The handle assembly of claim 3, the first bank including ends that are chamfered, and the second bank including ends that are chamfered.

7. The handle assembly of claim 1, each of the first and second fasteners including a tip configured to engage the first support member and the second support member, respectively, each tip having a conical configuration shaped to fit with the first neck portion and the second neck portion, respectively.

8. The handle assembly of claim 1, wherein each of the first interior perimeter and the second interior perimeter is configured as an oval with a first side at which the first protrusion and the second protrusion are formed and a second side at which the first inner hole and the second inner hole are formed, the first support member and the second support member are movable within the oval.

9. The handle assembly of claim 8, the location of the first support member within the first aperture configured to shift from the second side to the first side as the first fastener is inserted, the location of the second support member within the second aperture configured to shift from the second side to the first side as the second fastener is inserted.

10. The handle assembly of claim 1, wherein the first outer hole and the second outer hole extend transversely about the longitudinal axis.

11. The handle assembly of claim 1, wherein both the first insert and the second insert are inserted transversely to the longitudinal axis into the first opening and the second opening respectively.

12. The handle assembly according to claim 1, wherein the first protrusion engages the first support member, and the first fastener engages the first support member on a side opposite the first protrusion, and wherein the second protrusion engages the second support member, and the second fastener engages the second support member on a side opposite the second protrusion.

13. The handle assembly of claim 3, wherein the first protrusion tapers towards the first neck portion of the hourglass configuration of the first support member, and the second protrusion tapers towards the second neck portion of the hourglass configuration of the second support member.

14. The handle assembly of claim 3, wherein the first and second protrusions taper towards a plane that is transverse to a y axis perpendicular to the door.

* * * * *